United States Patent [19]

Fergestad

[11] 4,060,784

[45] Nov. 29, 1977

[54] ELECTRICAL INDUCTIVE APPARATUS

[75] Inventor: Petter I. Fergestad, Konnerud, Norway

[73] Assignee: A/S National Industri, Drammen, Norway

[21] Appl. No.: 743,827

[22] Filed: Nov. 22, 1976

[30] Foreign Application Priority Data

Jan. 14, 1976 Norway ..... 760124

[51] Int. Cl.[2] ..... H01F 15/04; H01F 27/28

[52] U.S. Cl. ..... 336/84 R; 336/177; 336/180; 336/223

[58] Field of Search ..... 336/177, 180, 182, 222, 336/223, 84, 212, 233

[56] References Cited

U.S. PATENT DOCUMENTS

| | | | |
|---|---|---|---|
| 1,605,557 | 11/1926 | Osnos | 336/177 |
| 3,247,476 | 4/1966 | Pintell | 336/177 |
| 3,774,134 | 11/1973 | Kardashian et al. | 336/177 X |

FOREIGN PATENT DOCUMENTS

| | | | |
|---|---|---|---|
| 1,315,659 | 5/1973 | United Kingdom | 336/177 |

*Primary Examiner*—Thomas J. Kozma
*Attorney, Agent, or Firm*—D. R. Lackey; W. M. Hanlon, Jr.

[57] ABSTRACT

An electrical winding for electrical inductive apparatus such as a transformer or electrical reactor having at least one winding formed of non-magnetic, electrically conductive sheet, strip or foil, such as copper or aluminum. Magnetically conductive material is disposed between at least certain of the turns of the electrically conductive sheet material to create a low reluctance path for magnetic leakage flux parallel to the winding axis to reduce the magnitude of the radial component of the leakage flux.

14 Claims, 5 Drawing Figures

ELECTRICAL INDUCTIVE APPARATUS

BACKGROUND OF THE INVENTION

1. Field of the Invention

The invention relates in general to electrical inductive apparatus, such as transformers and electrical reactors, and more specifically to such apparatus in which at least one of the windings is formed of electrically conductive sheet, strip or foil material.

2. Description of the Prior Art

In electrical inductive apparatus, such as transformers and electrical reactors, there is a magnetic leakage flux which goes outside of the magnetic core. The insulation space required between the primary and secondary windings of a transformer, for example, destroys the ideal coupling and contributes to the leakage flux. The leakage flux is the difference between the flux of the primary and secondary windings and is predominantly determinative of the reactance of the transformer.

The leakage flux is generated in the windings and is greatest in the cylindrical space between the primary and secondary windings. From the upper and lower part of this channel it must find a return path. A portion of the leakage flux finds its way inwardly against the magnetic core and it utilizes the magnetic core and core parts, such as the bolts and end frames, as a return path. Another portion of the leakage flux finds a return path through the oil and through such transformer parts which have the greatest permeability, for example through the tank walls. The leakage flux produces eddy current losses and hysteresis losses in these components. If one or more of the electrical windings is formed of sheet, strip or foil conductor, the radial component of the leakage flux produces losses in this type of winding. All of these losses combine to reduce not only the efficiency of the transformer, but they may also lead to harmful local heating which may break down and destroy electrical insulation adjacent thereto.

There have been proposed many arrangements for directing the leakage flux to provide a return path for it and avoid losses in the iron parts of the electrical apparatus. It is a known practice (German Pat. No. 366,467) to arrange magnetic shunts or yokes of magnetic laminations on both sides of the windings parallel to the yoke of the magnetic core to provide a low reluctance return path for leakage flux. It is also a known practice to arrange magnetic shunts between such yokes and the magnetic core in order to conduct the leakage fields over to the core (Swiss Pat. No. 365,791). Similarly, it is a known practice to form the pressure plates or parts of the pressure plates with magnetic laminations to conduct the leakage flux inwardly to the magnetic core (German Pat. No. 1,087,262and Norwegian Pat. No. 124,899). It has also been proposed (Electrical Times, March 1971, p. 53) to place magnetic shunts of magnetic laminations on the inside of the windings between the magnetic core and the innermost winding. Such magnetic shunts conduct the leakage flux around the end frames on the core, and thus it is possible to avoid local heating and losses in these components.

In both the primary and secondary windings the leakage fluxes will cause additional losses in the form of eddy current losses. Measurements have shown that the leakage flux in fully symmetrical windings has both an axial and a radial component. For such windings the radial component is about zero in the middle of the winding and it increases toward the axial ends of the winding. In other winding arrangements, for example with windings having different heights, divided windings, separate regulating windings, and the like, the magnitude of the radial flux components across the winding will be dependent upon the winding construction. It is generally well known that it is possible to reduce the additional losses in transformer windings by reducing the dimension of the conductor perpendicular to the flux.

In sheet, strip or foil windings there is a severe additional loss due to radial leakage flux, which limits the use of such windings to specific types of transformer constructions. It is known that it is possible to mount screens of electrically conductive material, especially around the winding ends in the case of sheet, strip or foil windings, in order to reduce the losses (British Pat. No. 990,418). Such screens will set up fields which oppose the leakage field, due to currents which are induced therein.

SUMMARY OF THE INVENTION

The present invention controls the radial flux component in windings of electrical inductive apparatus by providing a low reluctance path for the leakage flux in the axial direction, directing the leakage flux in a path which is outside of the electrical conductors of the winding so that it does not cut through the electrically conductive material. This is achieved in windings with sheet, strip or foil conductors by providing a magnetically conductive sheet, strip or foil, or other magnetically conductive material, which is wound together with the sheet, strip or foil of the electrical conductor.

The winding construction of the invention therefore reduces eddy current losses caused by leakage flux in the windings, especially at the ends of such windings, since the leakage flux is directed in an axial direction between the conductor turns and does not cut through the conductor.

The fact that the leakage flux will preferably follow the magnetically conductive material between the turns of the electrically conductive sheet material, instead of cutting through the electrically conductive sheet material, provides the advantage of being freer in the choice of conductor dimensions. One is no longer bound as in the prior art by upper limits for the thickness of the electrically conductive material in order to avoid losses as a consequence of leakage fluxes.

Since the leakage flux predominantly flows in the inlaid magnetically conductive material in the windings, it becomes easier to steer it inwardly toward and along the laminations in magnetic shunts and yokes. Magnetic shunts or yokes can be mounted to facilitate the return path of the leakage flux. An endeavor is made preferably to conduct the flux such that it goes in along the laminations in packs of such laminations, since flux which goes in obliquely or at a right angle to the laminations will cause additional losses.

Magnetic shunts in the prior art have had limited effect, since the flux has leaked out of the winding before it reaches the vicinity of the shunts. The present invention directs the leakage flux closer to these shunts and therefore improves their effect.

The windings in the spreading leakage field are subjected to mechanical forces which act in different directions, dependent upon the direction of the field. The spreading leakage flux causes both radial and axial forces in the windings. A short circuit may cause such great stresses on the windings that it becomes a severe problem to construct the windings mechanically to withstand the short circuit forces. In a winding constructed according to the invention, the radial spreading leakage flux is reduced. There is achieved, therefore, the significant advantage that the axial short circuit forces which act upon such a winding are substantially reduced.

Further, with a winding constructed according to the teachings of the invention, the axial magnetic leakage field will preferably follow the magnetically conductive material which is installed between the conductor turns of the winding, reducing the magnitude of the leakage flux which forces its way through the windings, which reduces the radial short circuit forces which act upon the current carrying conductors. The mechanical force on a conductor is, as is well known, given by the product of the current and field vector.

Coils or windings constructed according to the teachings of the invention will have greater mechanical strength against radial forces when the magnetically conductive material is a steel alloy constructed for use in electromagnetic apparatus. Such electrical steel, as is well known, has considerably greater mechanical strength than the electrically conductive material of which the windings are constructed, such as aluminum. There is achieved the advantage of being able to use, for example, pure aluminum with a high electrical conductivity level, as the electrically conductive winding material, instead of a specially alloyed aluminum which has been developed to give greater mechanical strength combined with a good conductivity level, which alloy is considerably more costly.

BRIEF DESCRIPTION OF THE DRAWING

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

Figure 1:
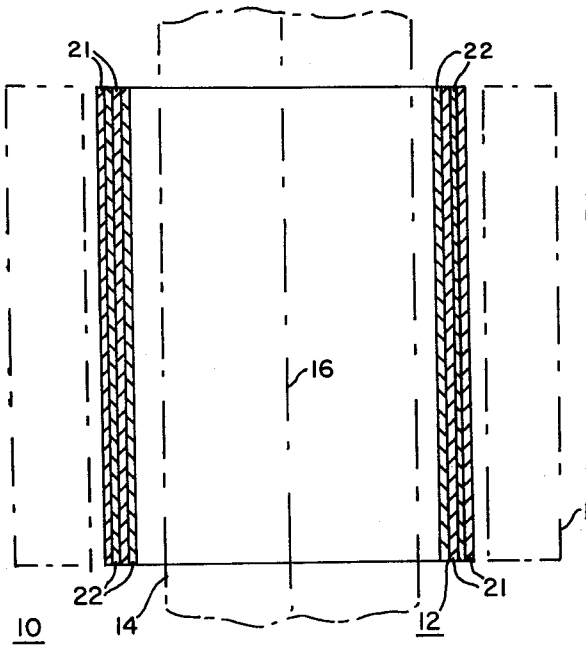
FIG. 1 illustrates schematically an axial section of an electrical winding having both electrically and magnetically conductive material applied in layers according to the teachings of the invention.

FIG. 1 is a fragmentary view, in section, of a transformer 10 having a coil or winding 12 constructed according to the teachings of the invention. A magnetic core leg 14 having a longitudinal axis 16, which axis is the centerline of the windings disposed thereon, and an additional concentrically disposed coil or winding 18, are illustrated in phantom in order to more clearly illustrate the teachings of the invention. The winding 12 is formed of non-magnetic, electrically conductive sheet, strip or foil, for example copper or aluminum, with the nested turns of such electrically conductive material being illustrated at 21. Between the turns 21 of the electrically conductive material is disposed magnetically conductive material, which may be a sheet, strip or foil having turns indicated at 22. The magnetically conductive sheet material 22, for example, electrical steel, is wound together with the electrically conductive sheet material of the windings to provide a spiral 21 of non-magnetic electrically conductive material, with a layer 22 of magnetically conductive material disposed between the turns of the spiral.

Figure 2:
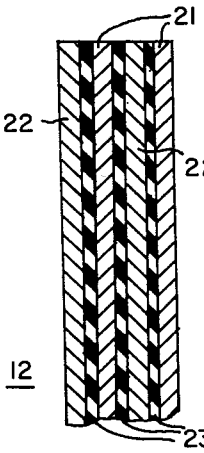
FIG. 2 illustrates on a larger scale a portion of the winding shown in FIG. 1, in which there is also illustrated electrical insulation disposed between the layers of the winding.

FIG. 2 is an enlarged, fragmentary view of the winding 12 shown in FIG. 1, which illustrates electrical insulating material 23 disposed between the electrically conductive material 21 and the magnetically conductive material 22. The insulation material 23 may be in the form of a sheet or strip of any desired insulating material. It may also be in the form of an insulating coating disposed on the electrically conductive sheet material, the magnetically conductive sheet material, or both.

The magnetically conductive sheet material, as hereinbefore indicated, may be made of alloyed steel plate commonly used in electromagnetic machines and apparatus. The electrical steel may be treated in such a way that the magnetic properties are alike in all directions. Ordinary commercial grain oriented electrical steel in which the magnetic properties are considerably improved in one direction may also be used. When the grain oriented electrical steel is used, the magnetically conductive material is preferably wound such that its direction of easier magnetization is in an axial direction, i.e., in a direction parallel to the centerline or winding axis 16.

The invention also covers the use of other magnetically conductive materials than those hereinbefore mentioned. All materials with a magnetic permeability greater than 1, in theory, may be used. Any type of unalloyed or alloyed iron or steel sheet which is easily available commercially may be used.

The magnetically conductive material 22 may also be formed as part of the winding insulation 23. Between each layer of the conductive sheet 21 there is a relatively low voltage since the layer stress is the same as the stress between a single turn. Thus, the electrical insulation need be formulated to withstand only such low turn-to-turn stress. A magnetically conductive powder material may be used in combination with the winding insulation to obtain a magnetically conductive sheet which is also electrically insulating at the electrical stresses involved. The magnetically conductive material 22 may also be formed by coating the sheet of insulation 23 with magnetically conductive powder on one or both of its sides.

Figure 3:
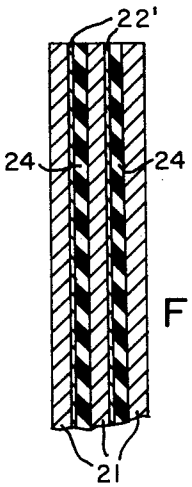
FIG. 3 is a sectional view, similar to FIG. 2, illustrating another embodiment of the invention.

FIG. 3 illustrates an embodiment of the invention wherein the reference 21 again signifies the nonmagnetic electrically conductive sheet, strip or foil, while the reference 24 signifies a sheet of insulating material with magnetically conductive material 22' disposed on one or both of its sides.

Another embodiment of the invention provides magnetically conductive powder between two sheets of insulation whereby there is again obtained a construction similar to that shown in FIG. 2. It is possible to vary the magnetic properties of such a composite sheet by varying the thickness or the amount of the magnetically conductive powder that is placed on or between the adjacent sheets of electrical insulating material. For example, the powder may be applied in spots or in a pattern, or as a complete surface. In the pattern embodiment, the raised portions or spots provide channels which facilitate the impregnation of the insulating material with oil.

The magnetically conductive powder may also produce or enter into a coating which is applied directly on the electrically conductive sheet, strip or foil. The magnetically conductive powder may be either applied directly to the conductive sheet, strip or foil, with a direct metallic contact between the magnetically and electrically conductive materials, or it may be applied as part of an insulation material.

An electrically conductive sheet, strip or foil with a magnetically conductive coating on one side and an insulating coating on the other side may be wound directly into a coil or winding. Such magnetically conductive coatings may, for example, be applied in the form of a paint. It is a known practice to use corrosion-preventive paint where the corrosion-preventive metal pigments have galvanic contact with one another. Instead of corrosion-preventive pigments it is possible to use magnetically conductive powder in a binder. Similarly, it is a practice known in radio technology to produce granules of magnetic materials in which the magnetically conductive particles are electrically insulated from one another.

Figure 4:
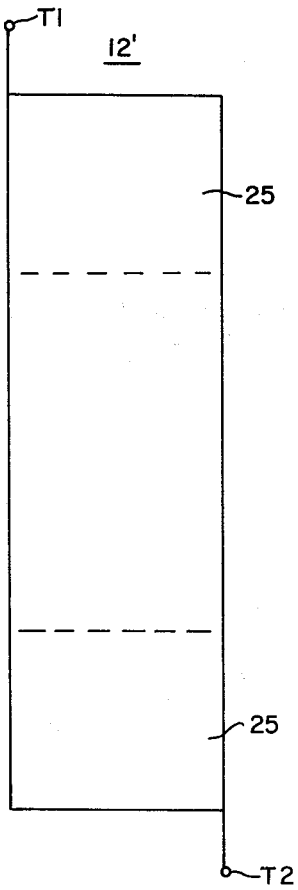
FIGS. 4 and 5 illustrate arrangements in which the magnetically conductive material may be concentrated in selected portions of a winding.

In the embodiment of the invention shown in FIG. 1, the magnetically conductive sheet extends over the entire winding height. Since the radial flux component, however, is greatest at the axial ends of the windings, in certain embodiments it will be sufficient to install magnetically conductive material only adjacent to the axial ends. FIG. 4 illustrates a winding 12' where the reference 25 signifies the portions of the winding ends where magnetically conductive material, such as sheet, strip or foil may be placed. Winding 12' is otherwise similer to winding 12 of FIG. 1, having a plurality of turns of electrically conductive material formed of sheet, strip or foil, the ends of which include electrical terminals T1 and T2 for connecting the winding to a source of electrical potential.

Figure 5:
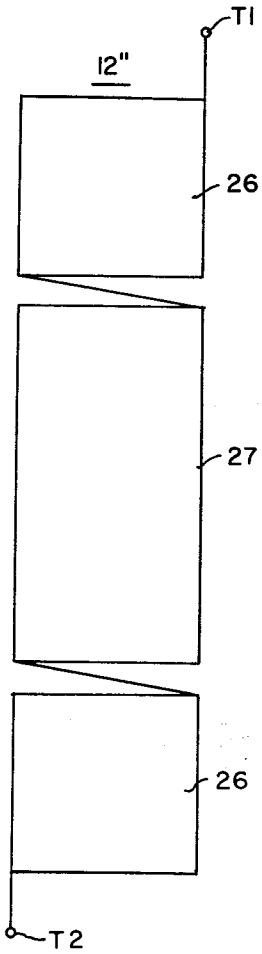

A winding for higher voltages, built up of series-coupled coils may have inlaid magnetically conductive material in all of the coils similar to the coils shown in FIG. 1. It is also possible for such a winding to be constructed as illustrated in FIG. 5, where the reference 26 signifies one or more partial coils at each winding end with inlaid magnetically conductive material, and 27 signifies one or more middle coils without magnetically conductive material. Each of the coils 26 would be constructed similar to the coils shown in FIG. 1.

There is a choice of having the magnetically conductive material 22 contribute as a current conductor or of letting it merely conduct magnetic field. In the first case, the sheets 21 and 22 will be parallel-coupled by joining them together at both ends. In the latter case, they will be joined with one another, such as at one end, to achieve the result that the magnetically conductive sheet 22 acquires a fixed potential without carrying winding current.

It is to be understood that the invention is applicable to embodiments in which both the primary and secondary windings are formed of sheet, strip or foil conductors, and also in those constructions which comprise a combination of sheet, strip or foil windings and disc windings formed of strap. For example, the high voltage winding may be constructed of disc-type coils and the low voltage winding may be constructed with sheet coils, with the magnetically conductive material being disposed in only the sheet coils.

I claim as my invention

1. An electrical inductive apparatus comprising:

a magnetic core, an electrical winding disposed in inductive relation around said core, said winding including a plurality of layers of non-magnetic, electrically conductive sheet material wound about a predetermined axis to provide a structure having first and second axial ends, electrical terminals connected to said sheet material adapted for connection to a source of electrical potential, a first magnetically conductive means disposed between at least certain of the layers of said conductive sheet material to provide a low reluctance path for magnetic flux in a direction parallel with said predetermined axis, and a second magnetically conductive means, disposed between said first magnetically conductive means and said core, for providing a return path for said magnetic flux to said core.

2. The electrical inductive apparatus of claim 1 wherein the magnetically conductive means is electrically connected to the sheet material to cause it to assume a predetermined potential when the electrical terminals are connected to a source of electrical potential without becoming a conductor of current flowing between the terminals.

3. An electrical winding, comprising:

a plurality of layers of non-magnetic, electrically conductive sheet material wound about a predetermined axis to provide a structure having first and second axial ends, electrical terminals connected to said sheet material adapted for connection to a source of electrical potential, and magnetically conductive means disposed between at least certain of the layers of said conductive sheet material to provide a low reluctance path for magnetic flux in a direction parallel with said predetermined axis, said magnetically conductive means being electrically connected in parallel with said sheet material, to cause said magnetically conductive means to conduct a portion of the electrical current flowing between the terminals, as well as magnetic flux.

4. The electrical inductive apparatus of claim 1 wherein the magnetically conductive means is disposed over the entire winding height, between the first and second axial ends of the winding.

5. The electrical inductive apparatus of claim 1 wherein the magnetically conductive means is disposed only adjacent the axial ends of the winding, providing a space between the axial ends which is free of such magnetically conductive means.

6. The electrical inductive apparatus of claim 1 wherein the magnetically conductive means is a sheet material.

7. The electrical inductive apparatus of claim 1 wherein the magnetically conductive means is a sheet material constructed of grain oriented electrical steel disposed with the direction of easier magnetization extending between the axial ends of the winding.

8. The electrical inductive apparatus of claim 1 including electrical insulating means disposed between the plurality of layers of electrically conductive sheet material, with the magnetically conductive means being a magnetically conductive powder carried by said electrical insulating means.

9. The electrical inductive apparatus of claim 8 wherein the electrical insulating means is a sheet material having a coating of the magnetically conductive powder on at least one of its sides.

10. The electrical inductive apparatus of claim 8 wherein the electrical insulating means includes two sheet materials with the magnetically conductive means disposed between them.

11. The electrical inductive apparatus of claim 1 wherein the magnetically conductive means is a metallic coating on at least on side of the electrically conductive sheet material, forming a direct metal-to-metal contact between the magnetically conductive material and the electrically conductive material.

12. The electrical inductive apparatus of claim 1 including an insulating coating on at least one side of the electrically conductive sheet material, and wherein the magnetically conductive means is a magnetically conductive metallic coating on the other side of said electrically conductive sheet material.

13. The electrical inductive apparatus of claim 1 including an insulating coating disposed on at least one side of the electrically conductive sheet material, with the magnetically conductive means being a magnetically conductive powder disposed in said insulating coating.

14. The electrical inductive apparatus of claim 1 wherein the magnetically conductive means is a magnetically conductive powder, the grains of which are electrically insulated from one another.

* * * * *